US006966124B2

(12) United States Patent
Ryu

(10) Patent No.: US 6,966,124 B2
(45) Date of Patent: Nov. 22, 2005

(54) DRUM WASHING MACHINE

(75) Inventor: Doo-Young Ryu, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/762,331

(22) Filed: Jan. 23, 2004

(65) Prior Publication Data

US 2004/0250442 A1 Dec. 16, 2004

(30) Foreign Application Priority Data

Jun. 13, 2003 (KR) ..... 10-2003-0038388

(51) Int. Cl.[7] ..... D06F 58/00

(52) U.S. Cl. ..... 34/134; 34/75; 34/77; 34/86; 34/131; 34/596; 34/604

(58) Field of Search ..... 34/72, 73, 75, 34/76, 77, 108, 130, 131, 132, 134, 59, 596, 34/597, 598, 604, 86, 595

(56) References Cited

U.S. PATENT DOCUMENTS

| | | | | |
|---|---|---|---|---|
| 4,103,433 | A | 8/1978 | Taylor | |
| 5,983,520 | A * | 11/1999 | Kim et al. | 34/261 |
| 6,497,107 | B2 * | 12/2002 | Maisotsenko et al. | 62/121 |
| 6,742,284 | B2 * | 6/2004 | Dinh | 34/514 |

FOREIGN PATENT DOCUMENTS

| | | |
|---|---|---|
| DE | 29 14 859 | 10/1980 |
| DE | 31 34 506 | 3/1983 |
| DE | 201 01 641 | 7/2002 |
| EP | 1 164 217 | 12/2001 |
| GB | 2 059 035 | 4/1981 |
| JP | 04-371198 | 12/1992 |

* cited by examiner

*Primary Examiner*—Jiping Lu
(74) *Attorney, Agent, or Firm*—Staas & Halsey LLP

(57) ABSTRACT

A drum washing machine, which has a clothes-drying unit with a plurality of heat pipes. The heat pipes recover, during a drying-mode operation of the drum washing machine, heat from high temperature humid air flowing from a water tub, and combine the recovered heat with low temperature dry air flowing from an area around a condensing nozzle, thus saving time and electricity during the drying-mode operation. In the clothes-drying unit, an air duct includes first and second duct parts, having a condensing nozzle installed in the first duct part, and a blower fan and a heater installed in the second duct part. A lower end of the heat pipe is arranged in a lower end of the first duct part, and an upper end of the heat pipe is arranged in an upper end of the first duct part. The heat pipe thus recovers the heat from the air, which flows in the lower end of the first duct part, and combines the recovered heat with the air, which flows in the upper end of the first duct part. The upper and lower ends of the heat pipe are each provided with a plurality of heat transfer fins which are spaced apart from each other at regular intervals, thus efficiently recovering and transferring the heat relative to the air flowing around the upper and lower ends of the heat pipe.

16 Claims, 3 Drawing Sheets

DRUM WASHING MACHINE

CROSS-REFERENCE TO RELATED APPLICATIONS

This application claims the benefit of Korean Application No. 2003-38388, filed Jun. 13, 2003, in the Korean Intellectual Property Office, the disclosure of which is incorporated herein by reference.

BACKGROUND OF THE INVENTION

1. Field of the Invention

The present invention relates, in general, to drum washing machines and, more particularly, to a drum washing machine which recovers heat during a drying-mode operation to dry clothes. The washing machine recovers heat from high temperature humid air flowing from a water tub and combines the recovered heat with low temperature dry air flowing from an area around a condensing nozzle, thus saving time and energy during the drying-mode operation.

2. Description of the Related Art

In conventional drum washing machines, a rotary tub is horizontally arranged in a cabinet so as to rotate clockwise and counterclockwise around a horizontal axis of the cabinet to repeatedly move clothes seated on an internal lower surface of the rotary tub along with wash water in an upward direction and allowing the clothes to be dropped due to gravity from a top to a bottom of the rotary tub, thus washing the clothes.

In the drum washing machines, the rotary tub is set in a water tub containing wash water therein, and rotates in the water tub by a drive motor. A door is mounted by a hinge to a front of the water tub, thus allowing a user to put the clothes into and take the clothes out of the rotary tub before and after washing the clothes.

Some models of the conventional drum washing machines are provided with clothes-drying units to dry wet clothes after washing the clothes. The clothes-drying units include an air duct installed around an outer surface of the water tub so as to communicate with an interior of the water tub, with a blower fan and with a heater installed in the air duct. In addition, a condensing nozzle is provided in the air duct to remove moisture from high temperature humid air, flowing from the water tub after passing through the clothes seated in the rotary tub, thus forming lower temperature dry air.

When the clothes in the rotary tub are completely washed and spin-dried through a washing-mode operation and a spin-drying-mode operation by rotation of the rotary tub, a drying-mode operation to dry the clothes begins. To start the drying-mode operation of the drum washing machine, both the blower fan and the heater installed in the air duct are turned on. During the drying-mode operation, the low temperature dry air flowing from an area around the condensing nozzle passes through the heater, t becoming heated and changing into high temperature dry air. The dry air is, thereafter, introduced into the water tub wherein the high temperature dry air passes through the clothes in the rotary tub, removing moisture from the wet clothes. While the high temperature dry air passes through the clothes, the dry air is humidified, becoming high temperature humid air. The humid air flows to the area around the condensing nozzle, becoming low temperature dry air again. The above-described cycle of the clothes-drying unit is repeated for a predetermined time period until the clothes are dried to a desired level.

However, the conventional drum washing machine having the clothes-drying unit has several drawbacks, as described below. When the high temperature humid air flowing from the clothes seated in the rotary tub passes through the area around the condensing nozzle which condenses moisture of the humid air to change the humid air into dry air, the temperature of the air is substantially reduced by cold water which is sprayed from the condensing nozzle to condense the moisture of the humid air. Therefore, the conventional drum washing machine must be provided with the large capacity heater to change the low temperature dry air into high temperature dry air, thus excessively consuming electricity. Furthermore, since it is necessary to heat the air by the large capacity heater in every cycle, the time required in the drying-mode operation is undesirably increased.

Typically, the drying-mode operation of the drum washing machine is performed for a lengthy period of time even though the drying time varies in accordance with a quantity of the clothes to be dried. However, the large capacity heater must be used in the conventional drum washing machine, thereby causing excessive power consumption by the drum washing machine and forcing the user to pay excessively for consumed electricity.

SUMMARY OF THE INVENTION

Accordingly, it is an aspect of the present invention to provide a drum washing machine, which recovers, during a drying-mode operation, heat from high temperature humid air flowing from a water tub and combines the recovered heat with low temperature dry air flowing from an area around a condensing nozzle, thus saving time and energy during the drying-mode operation.

Additional aspects and/or advantages of the invention will be set forth in part in the description which follows and, in part, will be obvious from the description, or may be learned by practice of the invention.

The above and/or other aspects are achieved by providing a drum washing machine, having: a water tub; a rotary tub rotatably installed in the water tub; and a clothes-drying unit to dry clothes contained in the rotary tub, wherein the clothes-drying unit includes: an air duct to form a closed air circulation system in cooperation with the water tub so as to circulate air through the closed air circulation system; a blower fan, a heater, and a condensing nozzle installed in the air duct; and a heat pipe to recover heat from the air having a high temperature and a high humidity before the air reaches the condensing nozzle, and to combine the recovered heat with the air having a low temperature and a dry state after the air passes through the condensing nozzle.

According to an aspect, of the drum washing machine, the air duct includes: a first duct part arranged at a rear end of the water tub, such that the first duct part communicates with an interior of the water tub at a bottom of the rear end of the water tub, and extends upward from the bottom to a top of the rear end of the water tub along an edge of the rear end of the water tub; and a second duct part extending from the rear end to a front end of the water tub, such that the second duct part communicates at a rear end thereof with the first duct part, and communicates at a front end thereof with the interior of the water tub.

According to another aspect, of the drum washing machine, the condensing nozzle is installed in the first duct part, and both the blower fan and the heater are installed in the second duct part.

According to another aspect, the heat pipe extends upward from the bottom to the top of the rear end of the water tub so as to be opposite to the first duct part, with a lower end of the heat pipe being arranged in a lower end of the first duct part, and an upper end of the heat pipe being arranged in an upper end of the first duct part, so that the heat pipe recovers the heat from the air having the high temperature and the high humidity which flows in the lower end of the first duct part, and transfers the recovered heat to the upper end of the first duct part, wherein the air having the low temperature and the dry state flows.

According to another aspect, the heat pipe is covered with a thermal insulation material at an intermediate part thereof, thus conducting the recovered heat from the lower end to the upper end thereof, without significant heat loss.

According to another aspect, the upper and lower ends of the heat pipe are each provided with a plurality of heat transfer fins which are spaced apart from each other at regular intervals, thus efficiently recovering and transferring the heat relative to the air flowing around the upper and lower ends of the heat pipe.

According to another aspect, the heat pipe and the heat transfer fins are preferably made of aluminum.

According to another aspect, the clothes-drying unit has two or more heat pipes.

According to another aspect, the drum washing machine of the present invention, a drying-mode method operation is also disclosed, comprising circulating high temperature dry air through a rotary tub producing high temperature humid air, recovering heat from the high temperature humid air through at least one heat pipe, combining the recovered heat with low temperature dry air flowing from the rotary tub, reheating the combined air producing high temperature dry air, and re-circulating the high temperature dry air through the rotary tub.

According to another aspect, the drum washing machine includes a clothes-drying unit having a plurality of pipes, wherein the pipes recover, during a drying-mode operation of the drum washing machine, heat from high temperature humid air after the high temperature humid air comes out of a water tub, and combines the recovered heat with low temperature dry air flowing from an area around a condensing nozzle.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
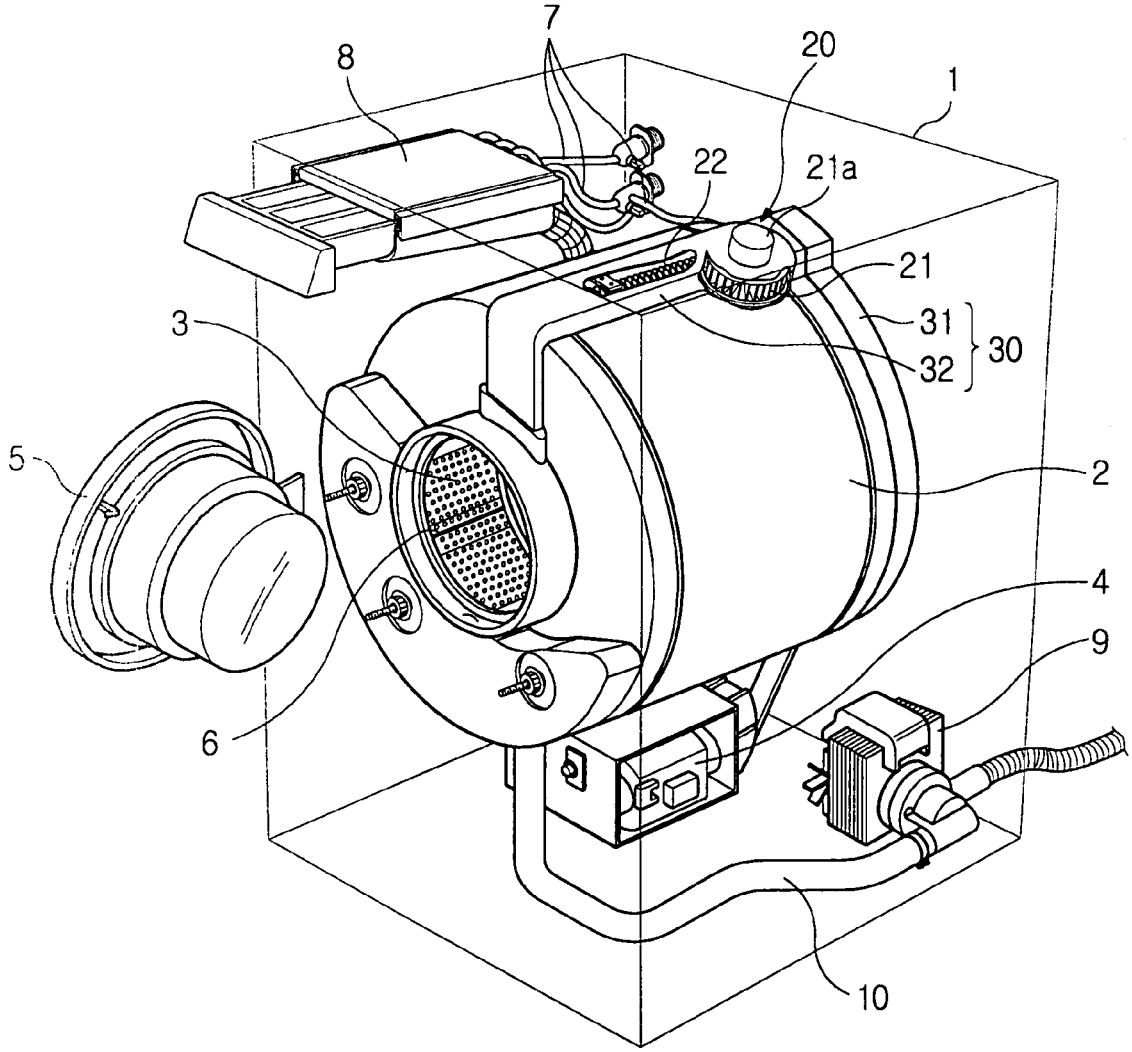
FIG. 1 is a perspective view of a drum washing machine provided with a clothes-drying unit, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
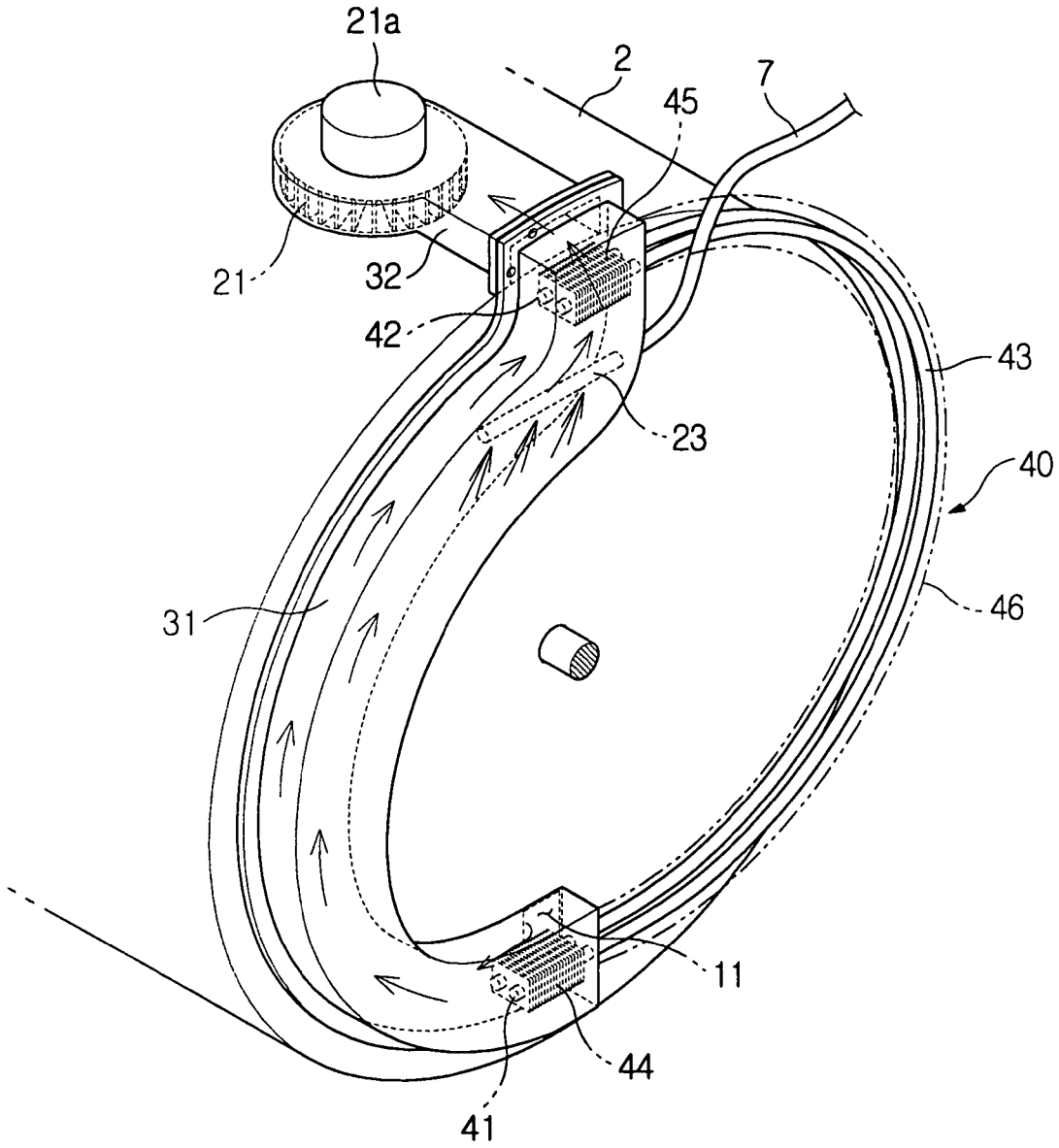
FIG. 2 is a perspective view of a part of the drum washing machine of FIG. 1 illustrating an arrangement of both an air duct and a plurality of heat pipes provided at a rear end of a water tub while facing each other.
Figure 3:
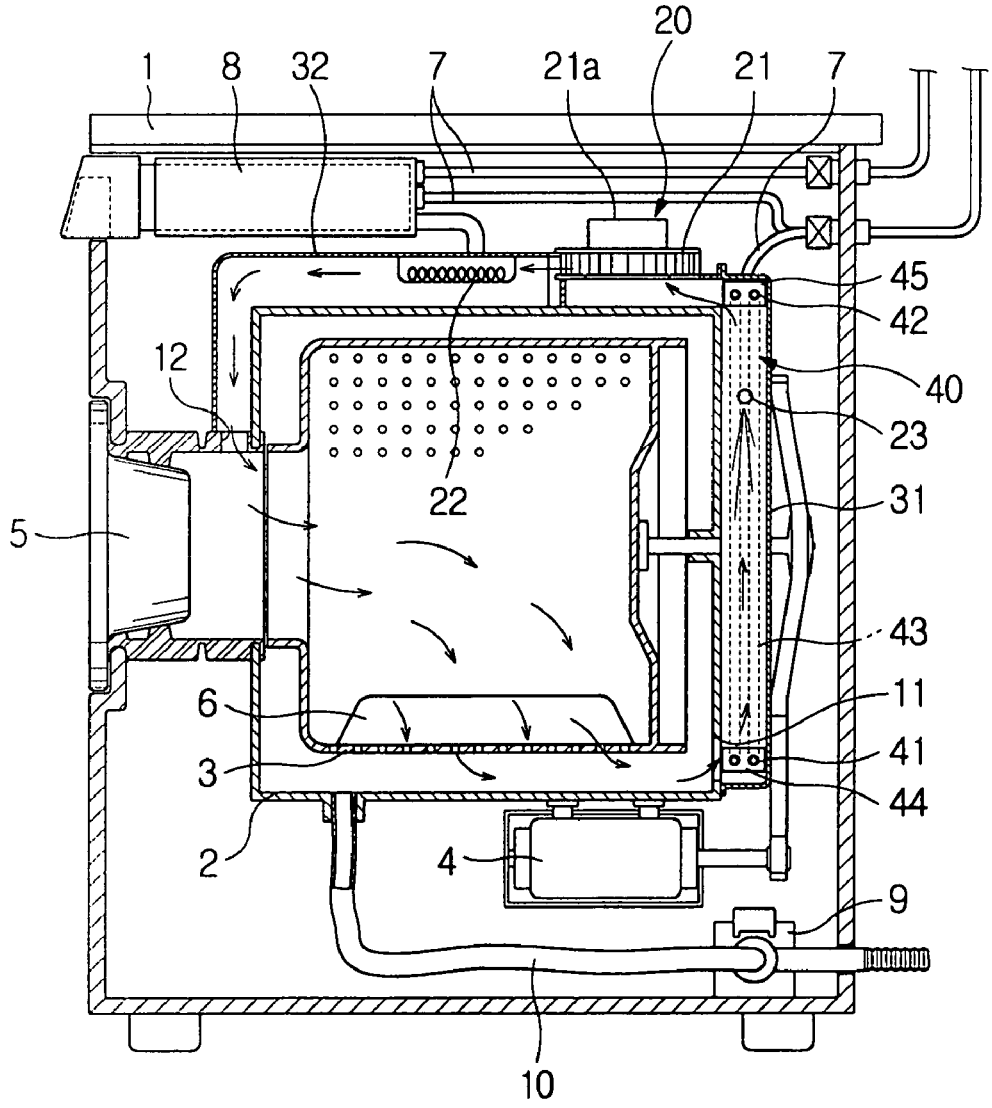
FIG. 3 is a sectional view of the drum washing machine of FIG. 1 illustrating a drying-mode operation of the drum washing machine, wherein air circulates through the clothes-drying unit and the water tub to dry wet clothes.

FIG. 1 is a perspective view of a drum washing machine provided with a clothes-drying unit, according to an embodiment of the present invention. FIG. 2 is a perspective view of a part of the drum washing machine of FIG. 1, illustrating an arrangement of both an air duct and a plurality of heat pipes provided at a rear end of a water tub while facing each other. FIG. 3 is a sectional view of the drum washing machine of FIG. 1, illustrating a drying-mode operation of the drum washing machine wherein air circulates through the clothes-drying unit and the water tub to dry wet clothes.

As illustrated in the drawings, the drum washing machine with the clothes-drying unit of the present invention includes a cabinet 1 which has a box shape and defines an appearance of the drum washing machine. A water tub 2 is horizontally arranged in the cabinet 1, and contains wash water therein. A rotary tub 3, which is perforated on a sidewall thereof to have perforations, is rotatably set in the water tub 2. The drum washing machine further includes a drive motor 4 to rotate the rotary tub 3 during a washing-mode operation and a spin-drying-mode operation wherein clothes in the rotary tub 3 are washed and spin-dried.

Both the water tub 2 and the rotary tub 3 are open at fronts thereof so as to allow a user to put the clothes into and take the clothes out of the rotary tub 3 before and after washing the clothes. A door 5 is mounted by a hinge to a front of the cabinet 1 so as to close or open the front of both the water tub 2 and the rotary tub 3. A plurality of lifters 6 are transversely arranged on an inner surface of the perforated sidewall of the rotary tub 3 with regular intervals, thus repeatedly moving upward the clothes seated on the inner lower surface of the rotary tub 3 along with wash water to a position of a predetermined height, in accordance with rotation of the rotary tub 2, and allowing the clothes to drop due to gravity from the position of the predetermined height to a bottom inside the rotary tub 2, thus washing the clothes.

Provided at a top of the cabinet 1 are a water supply hose 7 to supply wash water from an external water source into the water tub 2, and a detergent container 8 to add a detergent contained therein to the supplied wash water. A drain hose 10 with a drain pump 9 is provided at a bottom of the cabinet 1 while extending from the water tub 2 to an outside of the cabinet 1, thus draining wash water from the water tub 2 to the outside when necessary.

In the drum washing machine, the clothes-drying unit 20 according to the present invention is installed at an outer surface of the water tub 2 to blow high temperature dry air to the wet clothes contained in the rotary tub 2, thus quickly drying the wet clothes after washing the clothes.

The clothes-drying unit 20 includes an air duct 30, which is provided on the outer surface of the water tub 2 to communicate with an interior of the water tub 2, thus forming a closed air circulation system with the water tub 2. The clothes-drying unit 20 further includes a blower fan 21 to circulate the air through the closed air circulation system, and a heater 22 to heat the circulated air to a desired temperature, thereby drying the wet clothes by the use of the heated air. In addition, a condensing nozzle 23 is provided in the air duct 30 to condense moisture laden in the high temperature humid air, flowing from the water tub 2 after passing through the clothes seated in the rotary tub 3, thus making low temperature dry air. The clothes-drying unit 20 further includes a plurality of heat pipes 40 which recover heat from the high temperature humid air flowing from the water tub 2, and transfer the recovered heat to an upper end of the first duct part, wherein the low temperature dry air flows from an area around the condensing nozzle 23.

The air duct 30 of the clothes-drying unit 20 has a first duct part 31 and a second duct part 32. The first duct part 31 of the air duct 30 is arranged at a rear end of the water tub 2 to change the highly humid air, flowing from the clothes contained in the rotary tub 3, into lowly humid air. The second duct part 32 is arranged at a top of the water tub 2 to heat the lowly humid air flowing from the first duct part 31, thus changing the lowly humid air into the high temperature dry air, prior to feeding the air into the water tub 2.

At the rear end of the water tub 2, the first duct part 31 is connected at a lower end thereof to a first connection hole 11 provided at a bottom of the rear end of the water tub 2, such that the first duct part 31 communicates with the interior of the water tub 2. The first duct part 31 extends from the first connection hole 11 to the top of the rear end of the water tub 2 while being curved along a first half part of an edge of the rear end of the water tub 2, thus having an arc-shaped appearance.

The second duct part 32 is connected, at the top of a rear end of the water tub, to an upper end of the first duct part 31. The second duct part 32 axially extends from the top of the rear end of the water tub 2 to a front end of the water tub 2, and is connected to a second connection hole 12 provided at a front end of the water tub 2.

Each of the heat pipes 40 is arranged at the rear end of the water tub 2 while being inserted at a lower end 41 thereof into the lower end of the first duct part 31 to a predetermined length, and being inserted at an upper end 42 thereof into the upper end of the first duct part 31 to a predetermined length. An intermediate part 43 of each of the heat pipes 40 between the lower and upper ends 41 and 42 extends along a second half part of the edge of the rear end of the water tub 2, thus having an arc-shaped appearance, which is curved in a direction opposite to the curved direction of the first duct part 31.

The lower and upper ends 41 and 42 of each of the heat pipes 40, respectively arranged in the lower and upper ends of the first duct part 31, are provided with a plurality of first and second heat transfer fins 44 and 45 which are spaced apart from each other at regular intervals. The first and second heat transfer fins 44 and 45 enlarge heat transfer surfaces of the lower and upper ends 41 and 42, thus allowing the ends 41 and 42 to efficiently recover and transfer heat relative to the air flowing around the ends 41 and 42 in the first duct part 31. In the embodiment of the present invention, the heat pipes 40 and the heat transfer fins 44 and 45 are preferably made of a light material having high thermal conductivity, such as aluminum.

The intermediate parts 43 of the heat pipes 40 which are exposed to an outside of the first duct part 31, are covered with a thermal insulation material 46 to prevent heat dissipation therefrom. Due to the thermal insulation material 46, the heat, recovered at the lower ends 41 of the heat pipes 40, is efficiently conducted to the upper ends 42 through the intermediate parts 43, without significant heat loss.

The condensing nozzle 23, connected to the water supply hose 7, is arranged at a position under the upper ends 42 of the heat pipes 40 in the upper end of the first duct part 31. The condensing nozzle 23 sprays cold water in the upper end of the first duct part 31 to form a water curtain covering an entire sectional area of the upper end of the first duct part 31, thus condensing the moisture laden in the humid air flowing upward along the first duct part 31 into droplets which drop due to gravity. The humid air flowing around the condensing nozzle 23 thus becomes the low temperature dry air.

When the high temperature humid air flowing from the water tub 2 passes through the lower end of the first duct part 31, heat is transferred from the high temperature humid air to the lower ends 41 of the heat pipes 40 through the first heat transfer fins 44. That is, the lower ends 41 of the heat pipes 40 arranged in the lower end of the first duct part 31 recover the heat from the high temperature humid air flowing from the water tub 2. The temperature of the humid air flowing in the lower end of the first duct part 31 is thus reduced, while the temperature of the lower ends 41 of the heat pipes 40 is increased. The recovered heat is conducted from the lower ends 41 of the heat pipes 40 to the upper ends 42 through the intermediate parts 43. When the low temperature dry air flowing from the area around the condensing nozzle 23 passes around the heated upper ends 42 of the heat pipes 40, heat is efficiently transferred from the heated upper ends 42 to the low temperature dry air through the second heat transfer fins 45, thereby increasing the temperature of the dry air, before the dry air is introduced into the second duct part 32.

Both the blower fan 21 and the heater 22 are installed in the second duct part 32 communicating with the first duct part 31. The blower fan 21 is rotated by a fan motor 21*a* to circulate the air in the closed air circulation system, while the heater 22 heats the circulated air. In the embodiment of the present invention, the heater 22 is a heating coil, which is arranged along an entire width of the second duct part 32, so that the heater 22 dissipates heat to the air flowing around the heater 22 when the heater 22 is turned on.

Therefore, the primarily heated dry air which flows from the upper end of the first duct part 31, is secondarily heated by the heater 22 in the second duct part 32, thus being changed into the high temperature dry air, prior to being introduced into an interior of the rotary tub 3 through the second connection hole 12 provided at the front end of the water tub 2.

The drying mode operation of the drum washing machine having the above-described construction will be described herein below.

When the clothes contained in the rotary tub 3 are completely washed with the supplied wash water through the washing-mode operation, a rinsing-mode operation, and the spin-drying-mode operation, the drying-mode operation starts in order to dry the clothes. When the drying-mode operation starts, the rotary tub 3 rotates at a low speed, and, at the same time, the blower fan 21 and the heater 22 of the clothes-drying unit 20 are turned on.

When the blower fan 21 of the clothes-drying unit 20 is turned on, the air passing through the heater 22 in the second duct part 32, is changed into a high temperature dry air, for example, dry air of about 120° C. and 50% relative humidity, prior to being introduced into the interior of the rotary tub 3 through the second connection hole 12 provided at the front end of the water tub 2. While high temperature dry air passes through the wet clothes in the rotary tub 3, the air vaporizes the moisture from the wet clothes and is changed into the high temperature humid air, for example, humid air of about 80° C. and 100% relative humidity.

The high temperature humid air flows from the rotary tub 3 into the lower end of the first duct part 31 through the perforations of the rotary tub 3 and the first connection hole 11 provided at the rear end of the water tub 2. In the lower end of the first duct part 31, the lower ends 41 of the heat pipes 40 absorb heat from the high temperature humid air through the first heat transfer fins 44, thus recovering the heat. The high temperature humid air in the lower end of the first duct part 31 is thus changed into the intermediate temperature humid air, for example, humid air of about 60° C. and 100% relative humidity.

The intermediate temperature humid air flows from the lower end to the upper end of the first duct part 31, and comes into contact with the cold water sprayed from the condensing nozzle 23 arranged in the upper end of the first duct part 31. Therefore, the moisture laden in the intermediate temperature humid air is condensed into droplets by the cold water, so that the intermediate temperature humid air is changed into the low temperature dry air, for example, dry air of about 40° C. and 50% relative humidity.

In such a case, the droplets formed by condensing the moisture of the intermediate temperature humid air flow down along an inner surface of the first duct part 31 along with the cold water sprayed from the condensing nozzle 23, and are discharged into the interior of the water tub 2 through the first connection hole 11. The water is, thereafter, drained from the water tub 2 along with the wash water during a draining-mode operation of the drum washing machine.

The heat recovered from the high temperature humid air at the lower ends 41 of the heat pipes 40 through the first heat transfer fins 44, is transferred to the upper ends 42 of the heat pipes 40 through the intermediate parts 43 which are covered with the thermal insulation material 46. Therefore, the heat at the second heat transfer fins 45 provided at the upper ends 42 of the heat pipes 40 increases.

Meanwhile, the low temperature dry air flowing from the area around the condensing nozzle 23 passes through the second heat transfer fins 45 provided on the upper ends 42 of the heat pipes 40 at the position above the condensing nozzle 23, and is combined with the recovered heat at the upper ends 42 of the heat pipes 40 through the second heat transfer fins 45. The low temperature dry air is thus primarily heated and changed into the intermediate temperature dry air, for example, dry air of about 60° C. and 50% relative humidity. Thereafter, the intermediate temperature dry air passes through the second duct part 32 having the heater 22, thus being secondarily heated and changed into the high temperature dry air. The above-described circulation of the air is shown by the arrows in FIG. 3, and is repeated for a predetermined time period, thus quickly drying the clothes contained in the rotary tub 3.

As is apparent from the above description, the present invention provides a drum washing machine, which has a clothes-drying unit with a plurality of heat pipes. The heat pipes recover, during a drying-mode operation of the drum washing machine to dry clothes, heat from high temperature humid air just after the high temperature humid air comes out of a water tub, and combines the recovered heat with low temperature dry air flowing from an area around a condensing nozzle. Therefore, the clothes-drying unit effectively preheats the air just before the air is introduced to a heater, thus saving electricity during the drying-mode operation. In addition, the clothes-drying unit of the drum washing machine quickly increases a temperature of the air, thus saving time during the drying-mode operation.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A drum washing machine, comprising: a water tub, a rotary tub rotatably installed in the water tub, and a clothes-drying unit to dry clothes contained in the rotary tub, wherein the clothes-drying unit comprises:

an air duct to form a closed air circulation system in cooperation with the water tub so as to circulate air through the closed air circulation system;

a blower fan, a heater, and a condensing nozzle installed in the air duct; and a heat pipe to recover heat from air having a high temperature and a high humidity before the air reaches the condensing nozzle, and to combine the recovered heat with air having a low temperature and a dry state after the air having a high temperature and a high humidity passes through the condensing nozzle, wherein the air duct comprises:

a first duct part arranged at a rear end of the water tub, such that the first duct part communicates with an interior of the water tub at a bottom of the rear end of the water tub, and extends upward from the bottom to a top of the rear end of the water tub along an edge of the rear end of the water tub; and a second duct part extending from the rear end to a front end of the water tub, such that the second duct part communicates at a rear end of the water tub with the first duct part, and communicates at a front end of the water tub with the interior of the water tub.

2. The drum washing machine according to claim 1, wherein the condensing nozzle is installed in the first duct part, and both the blower fan and the heater are installed in the second duct part.

3. The drum washing machine according to claim 3, wherein the heat pipe extends upward from the bottom to the top of the rear end of the water tub so as to be opposite to the first duct part, with a lower end of the heat pipe being arranged in a lower end of the first duct part, and an upper end of the heat pipe being arranged in an upper end of the first duct part, so that the heat pipe recovers the heat from the air having the high temperature and the high humidity which flows in the lower end of the first duct part, and transfers the recovered heat to the upper end of the first duct part and combines the recovered heat with the air having the low temperature and the dry state which flows in the upper end of the first duct part.

4. The drum washing machine according to claim 3, wherein the heat pipe is covered with a thermal insulation material at an intermediate part thereof, thus transferring the recovered heat from the lower end to the upper end thereof, without significant heat loss.

5. The drum washing machine according to claim 3, wherein the upper and lower ends of the heat pipe are each provided with a plurality of heat transfer fins which are spaced apart from each other at regular intervals, thus recovering and transferring the heat relative to the air flowing around the upper and lower ends of the heat pipe.

6. The drum washing machine according to claim 5, wherein the heat pipe and the heat transfer fins are made of aluminum.

7. A drum washing machine, comprising:

a water tub;

a rotary tub rotatably installed in the water tub; and a clothes-drying unit to dry clothes contained in the rotary tub, wherein the clothes-drying unit comprises:

an air duct forming a closed air circulation system with the water tub so as to circulate air through the closed air circulation system, a blower fan, a heater, a nozzle installed in the air duct, and at least one heat pipe recovering heat at a lower end of the air duct from air having high temperature and high humidity and transferring the heat to an upper end of the air duct and combining the heat with air having a low temperature and a dry state, wherein the air duct comprises:

a first duct part arranged at a rear end of the water tub, such that the first duct part communicates with an interior of the water tub at a bottom of the rear end of the water tub, and extends upward from the bottom to a top of the rear end of the water tub along an edge of the rear end of the water tub; and a second duct part extending from the rear end to a front end of the water tub, such that the second duct part communicates at a rear end thereof with the first duct part, and communicates at a front end thereof with the interior of the water tub.

8. The drum washing machine according to claim 7, wherein the nozzle is installed in the first duct part, and both the blower fan and the heater are installed in the second duct part.

9. The drum washing machine according to claim 7, wherein the heat pipe is covered with a thermal insulation material at an intermediate part thereof, thus conducting the recovered heat from the lower end to the upper end of the air duct, without significant heat loss.

10. The drum washing machine according to claim 7, wherein upper and lower ends of the heat pipe are each provided with a plurality of heat transfer fins spaced apart from each other at regular intervals, recovering and transferring the heat flowing around the upper and lower ends of the heat pipe.

11. The drum washing machine according to claim 10, wherein the heat pipe and the heat transfer fins are made of aluminum.

12. The drum washing machine according to claim 7, wherein the blower fan and the heater are installed in the second duct part.

13. The drum washing machine according to claim 12, wherein the blower fan is rotated by a fan motor circulating air in the closed air circulation system.

14. The drum washing machine according to claim 7, wherein dry air flowing from an upper end of the first duct part, is heated by the heater in the second duct part, prior to being introduced into an interior of the rotary tub.

15. The drum washing machine according to claim 7, wherein the at least one heat pipe is arranged at a rear end of the water tub inserted at a lower end of the first duct part and at an upper end of the first duct part.

16. The drum washing machine according to claim 7, wherein an intermediate part of the at least one heat pipe extends along a second half part of an edge of a rear end of the water tub, curved in a direction opposite to a curved direction of the first duct part.

* * * * *

UNITED STATES PATENT AND TRADEMARK OFFICE

CERTIFICATE OF CORRECTION

PATENT NO. : 6,966,124 B2
APPLICATION NO. : 10/762331
DATED : November 22, 2005
INVENTOR(S) : Doo-Young Ryu It is certified that error appears in the above-identified patent and that said Letters Patent is hereby corrected as shown below:

Column 8,
Line 36, replace "claim 3" with -- claim 2 --.

Signed and Sealed this

Fourth Day of July, 2006

JON W. DUDAS
*Director of the United States Patent and Trademark Office*